United States Patent [19]

Seilly

[11] 4,270,502

[45] Jun. 2, 1981

[54] FUEL INJECTION PUMPING APPARATUS

[75] Inventor: Alec H. Seilly, North Wembley, England

[73] Assignee: Lucas Industries Limited, Birmingham, England

[21] Appl. No.: 36,011

[22] Filed: May 4, 1979

[30] Foreign Application Priority Data

Jun. 10, 1978 [GB] United Kingdom ..... 26656/78

[51] Int. Cl.[3] ..... F02D 11/10; F02M 59/24

[52] U.S. Cl. ..... 123/357; 123/361; 310/27

[58] Field of Search ..... 123/139 E, 140 R, 102; 310/12, 13, 14, 27, 49; 64/DIG. 2

[56] References Cited

U.S. PATENT DOCUMENTS

| | | | |
|---|---|---|---|
| 2,767,700 | 10/1956 | Parks | 123/140 R |
| 2,845,915 | 8/1958 | Frick | 123/140 R |
| 2,914,056 | 11/1959 | Hughson | 123/140 R |
| 3,587,540 | 6/1971 | Hofmann | 123/102 |
| 3,695,244 | 10/1972 | Vaville | 123/140 R |
| 3,750,633 | 8/1973 | Ohtani | 123/102 |
| 3,787,716 | 1/1974 | La France | 310/12 |
| 3,822,679 | 7/1974 | Hobo | 123/102 |
| 3,841,285 | 10/1974 | Müller | 123/140 R |
| 3,880,131 | 4/1975 | Twaddell | 123/139 E |
| 3,886,922 | 6/1975 | Frick | 123/140 R |
| 3,978,837 | 9/1976 | Lundberg | 123/102 |
| 4,039,725 | 7/1977 | Ito | 123/102 |
| 4,091,784 | 5/1978 | Seilly | 123/139 AT |
| 4,123,691 | 10/1978 | Seilly | 310/27 |
| 4,145,625 | 3/1979 | Seilly | 310/27 |

FOREIGN PATENT DOCUMENTS

| | | | |
|---|---|---|---|
| 822343 | 9/1937 | France | 123/140 FG |

*Primary Examiner*—Charles J. Myhre
*Assistant Examiner*—Carl Stuart Miller

[57] ABSTRACT

A fuel injection pumping apparatus includes an injection pump a control member operable to determine the amounts of fuel pumped by the apparatus. The setting of the control member is determined by a linear stepper motor mounted with a housing, a stepper motor having an armature coupled to the control member.

16 Claims, 6 Drawing Figures

FIG.2.
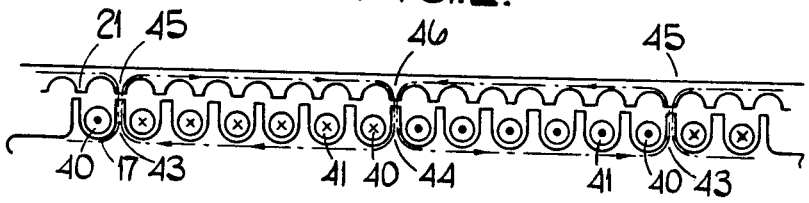
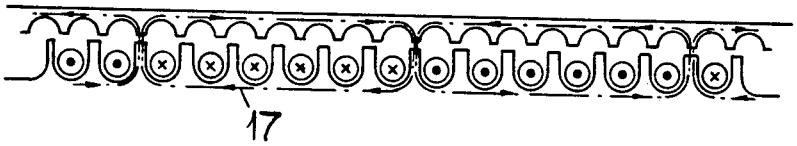
FIG.3.
FIG.4.
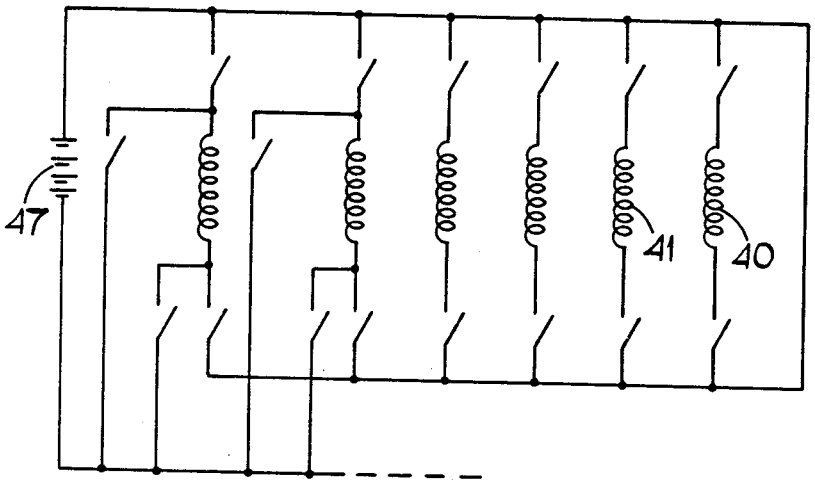

FUEL INJECTION PUMPING APPARATUS

This invention relates to a fuel injection pumping apparatus of the kind comprising an injection pump operable in timed relationship with an associated engine to deliver fuel to a combustion space of the engine, the apparatus having an axially movable control member the axial setting of which can be adjusted to determine the amount of fuel supplied at each injection stroke by the injection pump, and means for adjusting the setting of the control member.

Such apparatus is well known in the art. It is known to connect the control member to a mechanical governor which acts to determine the maximum speed of the associated engine. The governor includes a manually operable member whereby the speed and/or the power developed by the engine can be adjusted by an operator. The governor besides its maximum speed determining function also acts to determine and control the idling speed of the engine and is often equipped to control the maximum fuel curve at engine speeds between idling and maximum speed. In addition, the governor must be capable of allowing an additional quantity of fuel to be supplied by the apparatus for starting purposes.

Recent exhaust emission regulations dictate that the amount of fuel supplied to an engine must be very carefully controlled. The mechanical governor is not always able to provide the required degree of control and electronic systems have been developed to which various engine operating and desired operating parameters are supplied and which provides a signal representing the quantity of fuel required to be supplied to the engine. This signal is applied to an electromechanical actuator which moves the control member so that the apparatus supplies the desired amount of fuel.

One form of actuator comprises a rotary electromechanical actuator which includes an operating coil to which a signal of varying amplitude is supplied to vary the position of the control member. The actuator includes an output shaft which is coupled to the control member by means of a link. One disadvantage of this form of actuator is that it has a considerable inertia and is therefore slow acting.

The object of the present invention is to provide an apparatus of the kind specified in a simple and convenient form.

According to the invention an apparatus of the kind specified comprises an electrical linear stepper motor including an output member coupled to the control member.

According to a further feature of the invention a lost motion connection is positioned between the output member and the control member whereby the output member of the stepper motor can move to a new position even if movement of the control member is temporarily prevented.

One example of the fuel pumping apparatus in accordance with the invention will now be described with reference to the accompanying drawings in which:

FIGS. 2 and 3 show alternative relative settings of parts of the actuator, FIG. 4 is an electrical circuit diagram showing the connections of windings forming part of the actuator.

Figure 1:
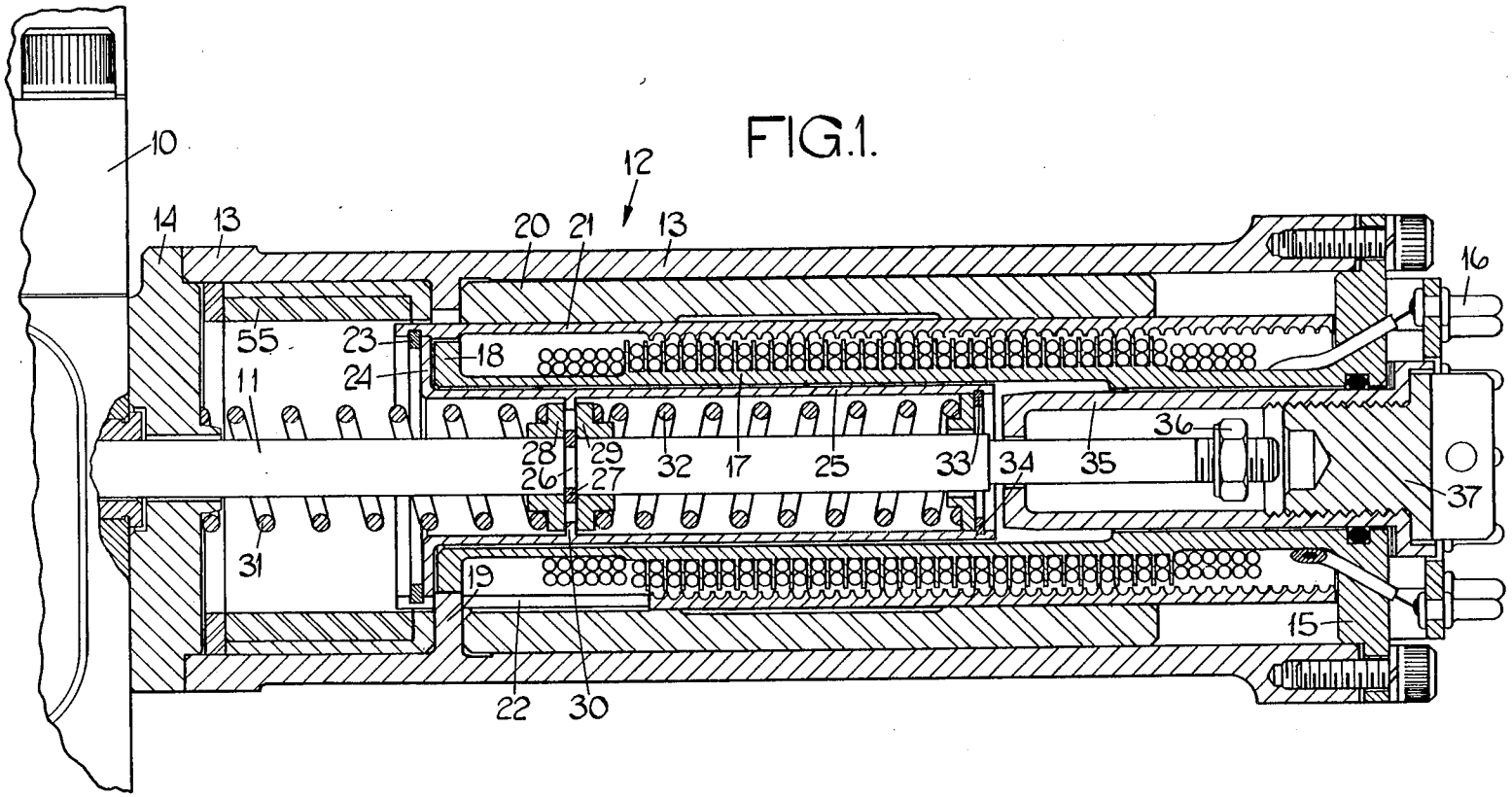
FIG. 1 is a sectional side elevation of the apparatus.

Referring to FIG. 1 of the drawings, a fuel injection pumping apparatus is indicated at 10 and is of the so-called in-line type. In other words it incorporates a plurality of individual injection pumps which deliver fuel to respective combustion spaces of an associated engine. This type of pump is well known and includes an axially movable control member 11 which projects from the casing of the apparatus. Axial movement of the control member affects variation in the amount of fuel supplied by each injection pump at each injection stroke.

In order to control the setting of the control member an electromagnetic actuator generally indicated at 12 is provided and this includes an outer cylindrical casing 13 having an end closure member 14 which is secured to the casing of the apparatus 10 and through which the control member 11 extends. The opposite end of the casing 13 is closed by a further end closure member 15 which carries electrical terminals 16 for connection to a power supply network as will be described.

The end closure carries a tubular stator portion 17 and this extends axially within the casing and at its end remote from the closure member 15 is provided with an outwardly extending flange 18. The flange 18 bears against an inwardly extending flange 19 which is formed on the casing but as will be explained, the two flanges engage each other at in the particular example, four angularly spaced positions, the remaining portions of the flange 19 being cut away as seen in the upper portion of FIG. 1.

The casing 13 also supports an annular bearing sleeve 20 and at one end this sleeve bears against the flange 19, the sleeve 20 being retained by means not shown.

The inner surface of the sleeve 20 is engaged by a tubular armature 21 and the inner surface of the armature 21 and the outer surface of the stator member 17, are formed with multi-start helical grooves. In the particular example the stator member 17 has a twelve start groove whilst the armature 21 has a fourteen start groove. As will be seen from the drawings, a clearance is provided between the crests of the ribs on the armature and the stator member 17 so that the armature member can be moved axially without mechanical interference with the stator member 17.

The armature 21 extends beyond the flanges 18 and 19 and in order to enable it to do this it is provided with axially extending slots one of which is seen at 22 positioned in a complimentary manner to the points of engagement between the flanges 18 and 19. In the extreme right hand position of the armature as shown in the drawings, the end portion of the armature just extends beyond the flanges 18 and 19 and the extended portion of the armature is provided with an internal circumferential groove which accommodates a spring clip 23. The spring clip 23 acts to retain an outwardly extending flange 24 formed on a further tubular member 25 against a step defined on the internal peripheral surface of the extending portion of the armature 21. Thus the tubular member is secured to the armature and therefore moves therewith.

The control member 11 extends within the further tubular member 25 and is provided with a circumferential groove 26 in which is located a ring 27. The ring 27 stands proud of the peripheral surface of the control member 11 and is engaged by a pair of spring abutments 28, 29 which can also engage with an inwardly extending projection 30 formed on the internal peripheral surface of the further tubular member 25.

The spring abutments 28, 29 are slidable on the control member 11 and the spring abutment 28 is engaged by a first coiled compression spring 31 the other end of which bears against the end closure member 14. The abutment 29 is engaged by a second coiled compression spring 32 and this extends within the further tubular member to bear against a further spring abutment 33 which engages a further circlip 34 carried within a groove in the internal peripheral surface of the further tubular member 25. The spring 32 is preloaded and the spring 31 is also subject to preload, the purpose of the spring 31 being to bias the control member 11 towards the minimum or zero fuel delivery setting. The purpose of the spring 32 will be described later.

The control member 11 has its end portion remote from the apparatus 10 of reduced diameter and this portion extends through an aperture formed in the base wall of a cup shaped member 35. The reduced portion of the control member carries an abutment which is in the form of a nut 36 which is in screw thread engagement with the control member. The cup shaped member 35 is slidably supported within the stator member 17 and it extends through the end closure 15. The open end of the cup shaped member 35 is closed by means of a plug which is in screw thread engagement with the cup shaped member. The outer end of the plug 37 is shaped so that it can be connected to an external control member such for example as a Bowden cable or a lever and it is intended for use in an emergency if for example the spring 31 should break or some fault occur in the electrical control system. When the plug 37 is moved towards the right as seen in FIG. 1, the cup shaped member 35 will undergo similar movement and the nut 36 will be engaged by the base wall of the cup shaped member. Thus axial movement can be imparted to the control member 11 to move it to the minimum or zero fuel position. It is possible to arrange that the plug 37 is used as the stop control for the associated engine.

For the moment it will be assumed that the armature 21 is capable of moving in discrete steps. The mechanism whereby this is achieved will be described later. In the drawing the armature 21 is shown in the extreme right hand position which corresponds to the minimum fuel position although as is explained above, it is possible for the control member to be moved further towards the right by operation of the cup shaped member 35. If now the armature 21 is moved by one step towards the left, similar movement will be imparted to the further tubular member 25 and through the projection 30, the spring 31 will be compressed however, by virtue of the action of the spring 32, the control member 11 will also move by the same distance towards the left. In practice when the control member is capable of moving the abutments 28, 29 will remain in contact with the projection 30 and the ring 27. Further movement of the armature will effect similar movement to the control member. In some cases however, movement of the control member will be prevented due to mechanical forces which are generated within the pumping apparatus. It has been found for example, that movement of the control member requires appreciably more force when an injection pump is partaking of an injection stroke and it is possible therefore, that the control member 11 will not move at the same time as the armature 21. In the event that this happens, the spring 31 will be compressed as previously described, but the control member 11 will be unable to move. As a result the spring 32 will be further compressed and the projection 30 and the ring 27 will move out of alignment. The armature however, will remain in the new position and the spring 32 will move the control member to the new position as soon as the restraining force on the control member is removed.

In like manner, if the armature has assumed for example, a mid position and it is required to move the control member towards the right thereby to reduce the amount of fuel supplied at each injection stroke, the spring 32 will be further compressed in the event that the control member 11 is unable to move following movement of the armature 21.

It will be appreciated that the armature 21 is of light construction and its inertia is therefore small. As a result rapid movement of the armature can take place.

Turning now to the electrical aspect of the actuator.

As previously described the grooves formed in the stator 17 form the equivalent of a twelve start thread with the grooves in the armature forming the equivalent of a fourteen start thread. Each groove on the stator accommodates a two turn winding, these being represented by the circles in the individual grooves. In practice, each winding may have more turns.

In order to explain more clearly how the windings are arranged and in order to describe the operation of the device, reference will be made to FIGS. 2 and 3. In these Figures the stator 17 and the armature 21 have the same arrangement of grooves namely the armature 21 is provided with a fourteen start groove system whilst the stator 17 is provided with a twelve start groove system. In FIGS. 2 and 3 however, each groove has only a single turn winding and in fact there are six windings. Each winding proceeds along one groove and returns along another groove. As a result when current is caused to flow through one winding, the direction of current flow in one groove is in one direction and in the groove in which the winding returns, the direction of current flow is in the opposite direction. This is illustrated by the windings referenced 40 and 41. As shown in FIG. 2 the armature and the stator are in an equilibrium position and it will be noted that two of the ribs on the stator are aligned with two of the ribs on the armature. The rib 43 on the stator is aligned with the rib 45 on the armature and similarly the rib 44 on the stator is aligned with the rib 46. This alignment occurs throughout the length of the stator and armature. Between the ribs 43 and 44 in FIG. 2, the direction of current flow in the windings is in the same direction, this direction being indicated by the dot and cross configuration. As a result of the current flow, a magnetic flux is generated and it will be seen that where the ribs are aligned the flow of flux is in the same direction on the opposite sides of the ribs hence so far as the main flux path is concerned, when the ribs are aligned, the flux path has the minimum reluctance. Therefore when the current is flowing, there will be a force generated which will tend to resist relative movement of the stator and armature in either direction. FIG. 3 shows the situation where the direction of current flow in one of the windings has been reversed. When the direction of current flow in the winding is reversed the main magnetic flux paths move along by one groove and the new flux path does not have a minimum reluctance. As a result relative movement of the stator and armature takes place so that the main flux paths have a minimum reluctance and the practical effect is that the armature moves so that adjacent ribs to the previously aligned ribs themselves align. If the direction of current flow in another winding is reversed, then further relative movement of stator and armatures takes place. Hence by switching the direction of current flow in the windings stepped motion of the armature can be obtained. Changing the direction of switching of the windings can produce relative movement in the opposite direction. Thus referring to FIG. 2 if the direction of current flow in the winding 40 were reversed then the movement of the armature would be towards the left as seen in FIG. 2 as opposed to the movement illustrated in FIG. 3, towards the right.

It will be appreciated that the lead of the threads is the same on the armature and the stator. If the lead of the thread is 24 mm then the relative movement of the armature when the direction of current flow in one winding is reversed will be 0.286 mm.

FIG. 4 shows a circuit for controlling the flow of current through the windings. In this case the windings are connected in parallel and certain connections i.e. those to the negative terminal of an accumulator 47 are omitted for the sake of clarity. Each end of each winding can be connected to either the positive or the negative terminal of the battery so that the direction of current flow through the winding can be determined. In practice the switches will comprise individual switching transistors controlled by a suitable logic circuit. The circuit of FIG. 4 also enables one or more of the windings to be de-energised and if the winding in which the direction of current flow is reversed between the positions shown in FIGS. 2 and 3 is disconnected from the accumulator then the main flux path due to the current flowing in the remaining windings has a reduced length and the relative movement of the stator and armature will be half that which occurs when the direction of current flow in the winding is reversed.

Figure 5:
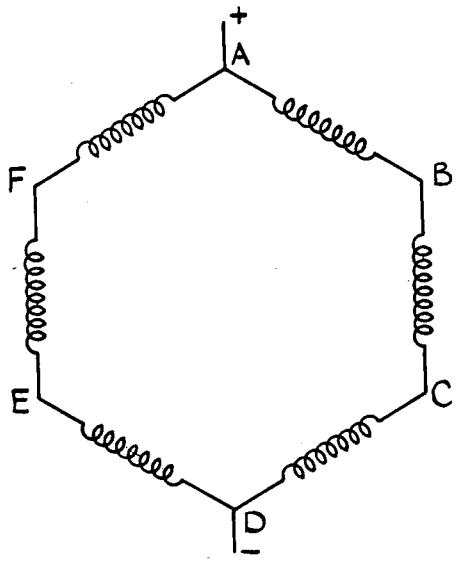
FIG. 5 is an alternative winding connection and FIG. 6 is a block diagram illustrating a fuel system for an internal combustion engine.

An alternative circuit is seen in FIG. 5 where the windings are connected in ring formation. As shown in FIG. 5 points A and D are connected to the terminals of the accumulator. When it is desired to change the direction of flow of current in one of the windings, point A is disconnected from the positive terminal of the accumulator and point B connected in its place. Thus the direction of current flow in one of the windings is reversed. When the direction of current flow in another winding is required to be reversed, point D would be disconnected from the negative terminal and point E connected in its place. Again transistorised switching arrangements can be provided to achieve the desired switching. It is desirable to have a minimum of six windings with this arrangement otherwise when the first change of connection occurs, there is a substantial increase in the current flow in two of the windings and a consequential decrease in the current flow in the remaining windings. This problem can be minimised to some extent by providing two windings in each slot. In the example described therefore there would be twelve windings. It is important to note however, that the direction of current flow in the two windings in each slot must be in the same direction whenever current is flowing. The windings are connected in series in a ring with the windings in the same slots diametrically disposed in the ring. With this method of connection, it is necessary to switch the two connection points to the ring at the same time. The current flow in the two branches of the ring remains the same.

Figure 6:
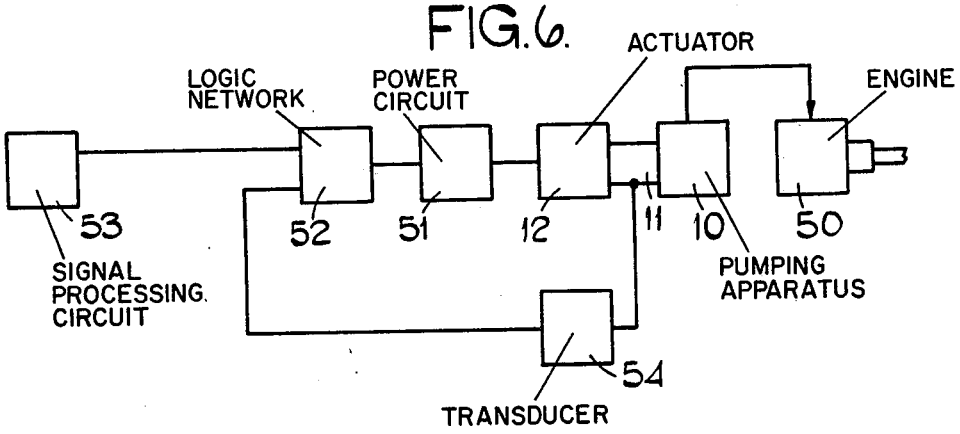

Referring now to FIG. 6 the pumping apparatus 10 is shown to be supplying fuel to an engine indicated at 50. The actuator 12 controls the position of the control member 11 and itself includes the aforesaid windings to which power is supplied by means of a power circuit 51 which is connected to the terminals indicated at 16, in FIG. 1. The power circuit comprises a plurality of transistors the conduction of which is controlled by logic network 52 which itself receives a control signal from a signal processing circuit 53. The signal from the processing circuit 53 represents the amount of fuel which is to be supplied to the engine and the processing circuit 53 will receive a signal representing the speed of the engine so that it can act to control the maximum speed of the engine and can also act to adjust the maximum amount of fuel which can be supplied to the engine in accordance with the speed. In addition the processing circuit will receive a signal indicative of the desired speed or power of the engine as determined by the operator. The processing circuit will include various circuits which shape the maximum speed/fuel curve so that the engine is capable of operating at its maximum power without emission of excessive smoke in its exhaust.

In the example described it has been stated that the armature can move irrespective of whether the control member is capable of moving at the particular instant of movement of the armature. With this arrangement therefore the armature should always be in the position determined by the logic network 52.

It is possible however, to connect the armature directly to the control member and therefore it would be possible for the armature to move out of step with the logic network. For this reason in the latter case it would be essential to provide a transducer capable of providing a signal to the logic network of the position of the armature. Moreover, even in the case of the example described with reference to FIG. 1 it could be desirable to have such a transducer. The transducer is indicated at 54 in FIG. 6. It may be a capacitive transducer with one plate of the transducer being formed by the armature 21 and the other plate of the transducer being supported on an electrically insulating sleeve 55 which surrounds the spring 31 and is held within the casing 13 of the actuator.

It will be appreciated that whilst the armature 21 in the arrangement shown in FIG. 1 is supported for movement by means of a sleeve 20, it can be supported by means of a linear bearing comprising a plurality of balls. In any case, the sleeve 20 is relieved along its internal periphery, to reduce the degree of friction between the armature and the sleeve.

I claim:

1. A fuel injection pumping apparatus comprising an injection pump operable in use, in timed relationship with an associated engine to deliver fuel to a combustion space of the engine, a movable control member the axial setting of which determines the amount of fuel supplied at each injection stroke by the injection pump, a linear stepper motor including an output member coupled to the control member, a lost motion connection positioned between the output member and the control member whereby the output member can move to a new position even if movement of the control member is temporarily prevented, said stepper motor further including a housing, a sleeve mounted with the housing, said output member comprising a hollow cylindrical armature located within the sleeve and guided for axial movement thereby, an annular stator extending within the armature, electrical windings carried by the stator member and which can be selectively arranged to alter the relative axial setting of the armature and stator member, a tubular member located within the stator member, means coupling the armature to the tubular member, said control member extending through the tubular member, a first abutment defined on the internal surface of the tubular member and a second abutment defined on the control member, a pair of spring abutments slidable on the control member and located on the opposite sides of said first abutment, and a pair of resilient means acting on said pair of abutments respectively to maintain the spring abutments in engagement with said first and second abutments.

2. An apparatus according to claim 1, in which said pair of resilient means comprises a pair of coiled compression springs, one of said springs engaging a part connected to the housing and the other of said springs engaging a part secured within said tubular member, said other spring being preloaded and said one spring acting to bias the control member towards a predetermined fuel setting.

3. An apparatus according to claim 2, in which said part connected to the housing comprises an end closure member for the housing, said part secured within the tubular member comprising a circlip located within a groove formed in the internal peripheral surface of the tubular member.

4. An apparatus according to claim 1 including an inwardly extending flange on the housing and an outwardly extending flange on the stator member, said flanges being axially aligned and the peripheral surface of said flanges engaging with each other, one of said flanges defining a plurality of apertures, the armature being slotted at one end and the legs defined by said slots extending through said apertures.

5. An apparatus according to claim 4 in which the tubular member defines an outwardly extending flange which is located within said legs, said legs defining shoulders for engagement by said flange on the tubular member and the legs having circumferential grooves formed on the internal surfaces thereof and a circlip located within said grooves and acting to retain said flange against said shoulders.

6. An apparatus according to claim 5 in which the flange on the stator member is situated at one end thereof, the other end of the stator member being carried by an end closure of the housing.

7. An apparatus according to claim 6, including means carried by said end closure and operable from the exterior of the housing to effect movement of the control member.

8. An apparatus according to claim 7 in which said means comprises a cup-shaped member extending through the end closure and slidably supported by the stator member, said control member having its end portion extending through an aperture in the base wall of the cup shaped member and an adjustable abutment located on the control member for engagement with the base wall when said cup-shaped member is moved.

9. An apparatus according to claim 8, including a plug closing the end of the cup shaped member remote from the base wall said plug being adapted for connection to an external control member.

10. An apparatus according to claim 1, in which the presented surfaces of the armature and stator member are each provided with an even number of helical threads, the threads defining ribs on the surfaces, said windings being located in the grooves on the stator member and each winding being formed from a turn of wire which extends along one groove from one end of the stator member and returns to said one end of the stator member along another groove, the number of threads on the armature being different from the number of threads on the stator member, the lead of the threads on the armature and the stator member being the same.

11. An apparatus according to claim 10, in which each winding comprises a number of turns.

12. An apparatus according to claim 10, including switch means operable in use to selectively connect the windings in parallel across a source of electric supply.

13. An apparatus according to claim 10 in which said windings are connected in series in a winding ring and switch means is provided to selectively connect the connection points of the windings across a source of electric supply.

14. An apparatus according to claim 13, in which the grooves on the stator member accommodate a pair of windings, windings in the same grooves being connected at opposite positions in the winding ring.

15. An apparatus according to claim 10, including a power circuit for controlling the flow of electric current through the windings, a logic unit for controlling the power circuit so that the appropriate windings are energised when movement of the control member is required and a signal processing circuit for supplying a control signal to the logic unit.

16. An apparatus according to claim 15, including a transducer for supplying a signal to said logic unit indicative of the axial position of the armature.

* * * * *